US010731522B2

(12) United States Patent
Ardezzone

(10) Patent No.: US 10,731,522 B2
(45) Date of Patent: Aug. 4, 2020

(54) SECURE ENGINE INSERT AND PROCESS FOR INSTALLING

(71) Applicant: Frank J. Ardezzone, Santa Clara, CA (US)

(72) Inventor: Frank J. Ardezzone, Santa Clara, CA (US)

( * ) Notice: Subject to any disclaimer, the term of this patent is extended or adjusted under 35 U.S.C. 154(b) by 0 days.

(21) Appl. No.: 16/134,877

(22) Filed: Sep. 18, 2018

(65) Prior Publication Data

US 2019/0017419 A1 Jan. 17, 2019

Related U.S. Application Data

(63) Continuation-in-part of application No. 15/257,867, filed on Sep. 6, 2016, now Pat. No. 10,077,735, which is a continuation-in-part of application No. 15/150,390, filed on May 9, 2016, now abandoned.

(60) Provisional application No. 62/214,201, filed on Sep. 4, 2015, provisional application No. 62/158,487, filed on May 7, 2015.

(51) Int. Cl.
*F01L 3/02* (2006.01)
*F01L 3/22* (2006.01)

(52) U.S. Cl.
CPC *F01L 3/02* (2013.01); *F01L 3/22* (2013.01); *F01L 2103/00* (2013.01)

(58) Field of Classification Search
CPC ..... F01L 3/02; F01L 3/22; F01L 2103/00
See application file for complete search history.

(56) References Cited

U.S. PATENT DOCUMENTS 2,165,311 A * 7/1939 Stancliff ..... F01L 3/22 123/188.1
2,800,122 A * 7/1957 Howell ..... F01L 3/22 123/188.8
3,285,235 A * 11/1966 Ueberschaer ..... F01L 3/22 123/188.8

* cited by examiner

*Primary Examiner* — Jacob M Amick
*Assistant Examiner* — Charles Brauch
(74) *Attorney, Agent, or Firm* — Law Office of Craig Bohn; Craig E. Bohn

(57) ABSTRACT

An engine insert having an insert appendage that projects outwardly from the insert body in a direction away from the seat face, into an engine, such as to form an engine finger void between the appendage and the insert axis, in which engine finger void a finger of engine material may be positioned between the insert appendage and the insert axis.

13 Claims, 6 Drawing Sheets

SECURE ENGINE INSERT AND PROCESS FOR INSTALLING

CROSS-REFERENCE TO RELATED APPLICATIONS

This application claims the benefit of U.S. application Ser. No. 15/257,867, filed on May 9, 2016, issued as U.S. Pat. No. 10,077,735 on Sep. 18, 2018, by the present inventor, entitled "Captured Engine Cylinder Sleeve and Coating," which is a Continuation in part of U.S. application Ser. No. 15/150,390, filed on May 9, 2016, by the present inventor, entitled "Engine Insert and Process for Installing," and claimed priority from U.S. Provisional Application No. 62/214,201, filed on Sep. 4, 2015, by the present inventor, entitled "Engine Cylinder Sleeve and Process for Installing," U.S. Provisional Application No. 62/214,203, filed on Sep. 4, 2015, by the present inventor, entitled "Coated Cylinder Wall and Process for Making," and U.S. Provisional Application No. 62/158,487, filed on May 7, 2015, by the present inventor, entitled "Engine Insert and Process for Installing." All of these prior submissions on related engine insert technologies are hereby incorporated by reference in their entirety for all allowable purposes, including the incorporation and preservation of any and all rights to patentable subject matter of the inventor, such as features, elements, processes and process steps, and improvements that may supplement or relate to the subject matter described herein.

STATEMENT REGARDING FEDERALLY SPONSORED RESEARCH OR DEVELOPMENT

Not Applicable

BACKGROUND OF THE INVENTION

This invention relates generally to internal combustion engine inserts, and more specifically, to a valve seat configuration and installation process that establishes secure seat retention in an engine where the engine and seat have dissimilar coefficients of expansion.

The field of manufacturing internal combustion engines has slowly developed over the past two centuries. Today, various materials are used in the engines and the engine components in an attempt to reduce weight, dissipate heat, and increase durability and reliability. For a long time the sealing surface of the intake and exhaust valves have employed special materials for the valves and perimeter of the manifold opening, known as a seat, to ensure proper selective fluid flow and sealing. With varied materials come varied physical properties, some which are desired, such as durability and heat dissipation, and some that are not desirable, such as differing thermal expansion. In particular, different coefficients of thermal expansion of the engine material of the part of the engine where the seat is placed and the seat material has been a problem to the field for a long time.

When the engine in which the seat is seated and the seat have differing coefficients of expansion, when the engine gets hot it expands at a different rate than the seat. Additionally, when the engine and seat get extremely cold, and then are started, the parts heat at different rates. In either scenario seats may become loose and interfere with the function of the valve and pistons, causing severe damage. Even recently, a major engine builder noted difficulty with "seats loosening up and dropping out in some of its late model 4.7 liter and 5.7 liter . . . engines" in an article in "Engine Builder Magazine," entitled "Valve Seat Selection, Finishing & Materials." This is in spite of the industry accepted best practice of heating the engine to over 200 degrees in a furnace, while chilling the seats with dry ice or liquid nitrogen, in order to press-fit the temporarily shrunk seat into the temporarily enlarged bore in the engine. Even with this augmented interference fit, experts in the field are still experiencing difficulties.

Prior solutions have looked to include a threaded interface between the seat and the engine, but such configurations are found to creep apart during expansion and contraction cycles. Alternative prior solutions have looked at deformation of the seat upon insertion into the engine, but such configurations are found to also creep apart during expansion and contraction cycles. Additionally, a material malable enough to deform will deform again under operational conditions.

It would be an improvement to the field of art to have the valve seat and engine design where the interference fit between the engine and the seat does not greatly diminish with extreme temperatures and the rapid change in temperatures.

SUMMARY OF THE INVENTION

The present development is an engine insert, such as a valve seat, having an appendage that projects outwardly from the seat body in a direction away from the seat face, into an engine, such as to form an engine finger void between the appendage and the seat axis for a finger of engine material to be positioned between the valve seat appendage and the valve channel. The present design and process will result in increased retention impingement between the valve seat appendage and the finger of engine material, which offsets other diminished impingement areas between the appendaged valve seat and the engine. This applies to various engine and seat combinations of dissimilar materials over a large temperature range. The appendaged valve seat permits a process of securely press-fitting of the seat into the engine at ambient temperatures.

DESCRIPTION OF THE PREFERRED EMBODIMENT

It is understood that valves, and their corresponding intake and exhaust ports, may be positioned in various locations in the engine, and may have varied orientations. The current disclosure will discuss a configuration where the valves and valve channels are located in the engine head, and the valves are generally shown to be positioned above the bulk of the combustion chamber. However, the current device and process may be used in engines where the valves and valve channels are otherwise located, such as being positioned in the engine block or being below the combustion chambers. It is also understood that the engine valves and valve channels are radially circular in structure, to provide even seal and pressure distribution around the perimeters. It is for that reason terms like "cylindrical," "cylindrically parallel," "radially parallel," and "coaxial" are used to describe and mean multiple surfaces that uniformly encircle a common axis, and each surface at a different distance from that axis, which includes that adjacent parallel surfaces may be touching.

Figure 1:
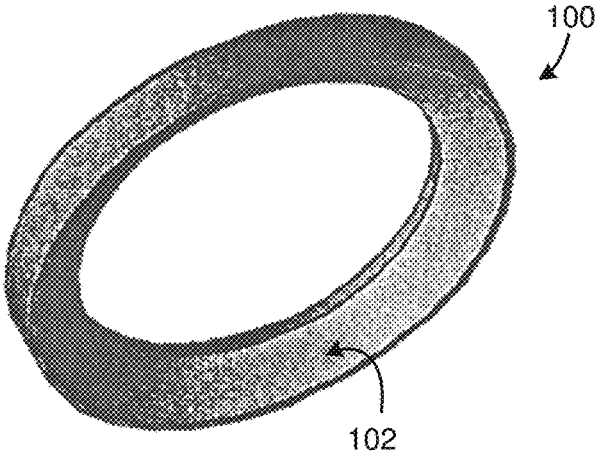
FIG. 1 is a perspective view of an exemplary appendaged seat according to the present invention.
Figure 2:
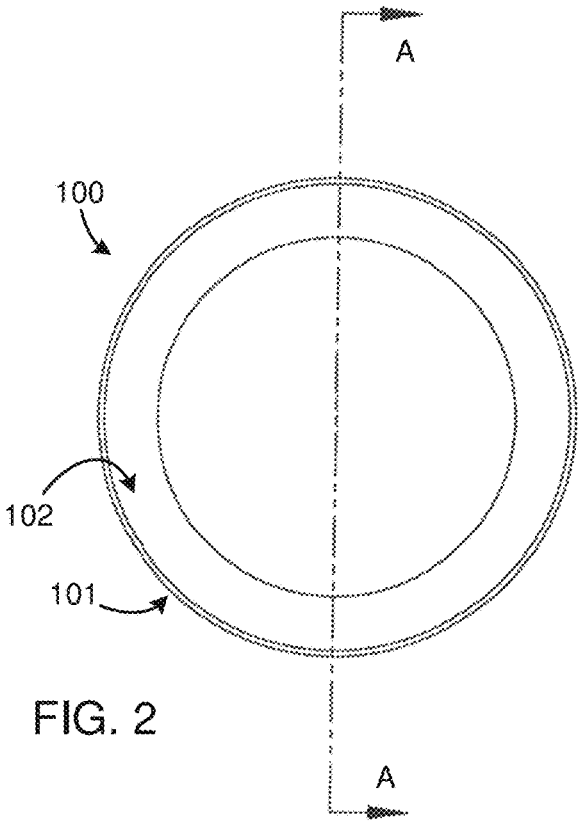
FIG. 2 is a seat face side view of the seat in FIG. 1.
Figure 3:
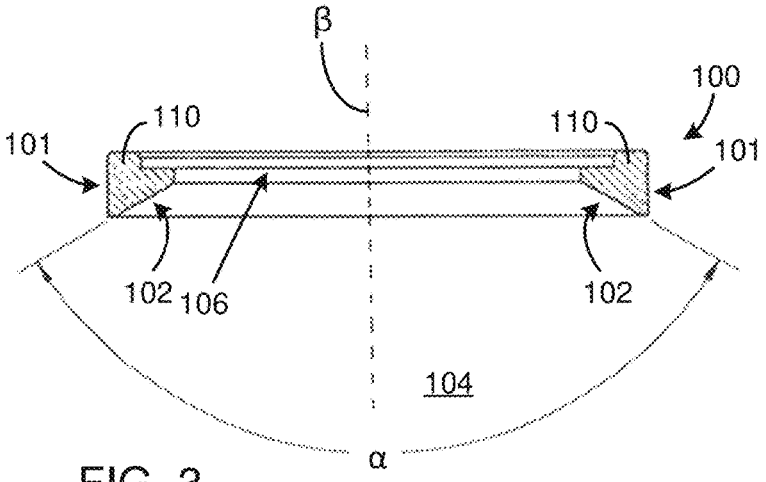
FIG. 3 is a side view normal to the cut side of the valve in FIG. 2, cut at line A-A.
Figure 4A:
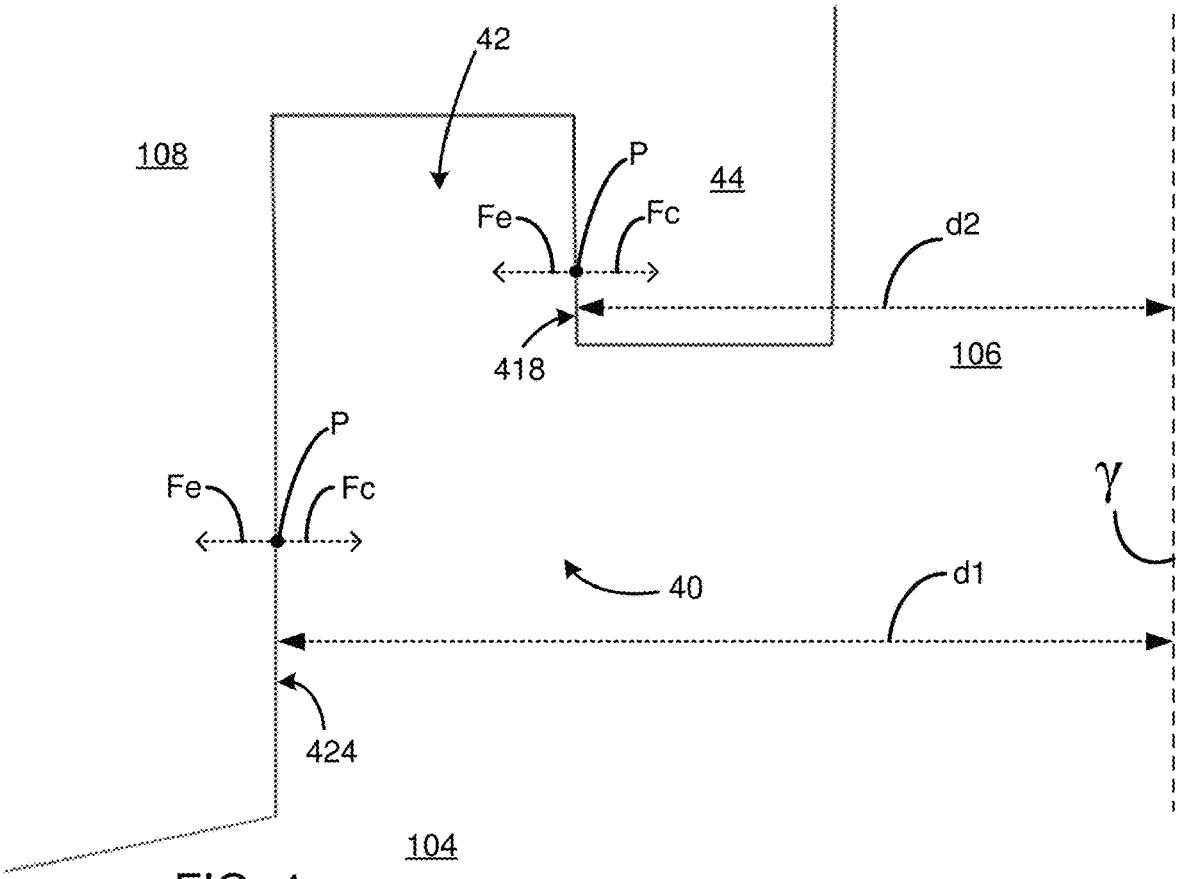
FIG. 4*a* is a schematic cross-sectional side view illustration of a modified valve seat well in an engine according to the present invention.
Figure 4B:
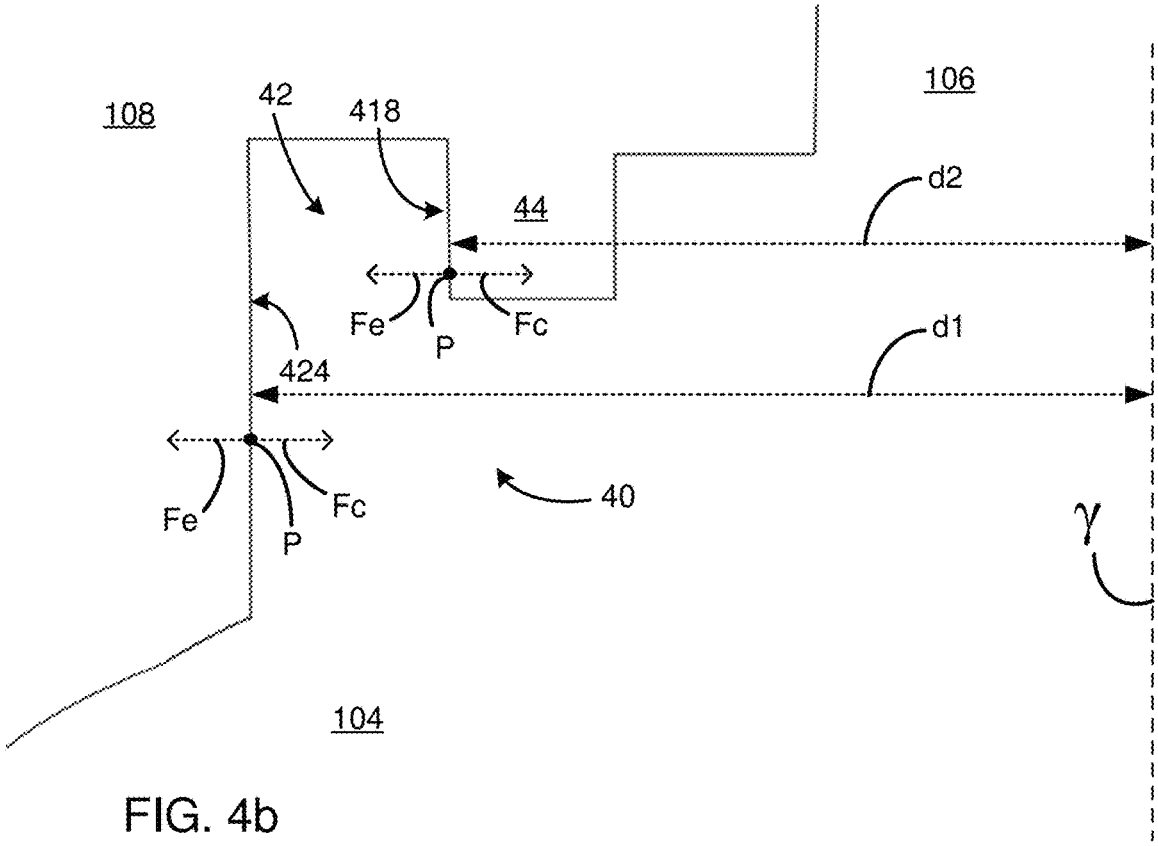
FIG. 4*b* is a schematic cross-sectional side view of an alternate valve seat well according to the present invention.
Figure 4C:
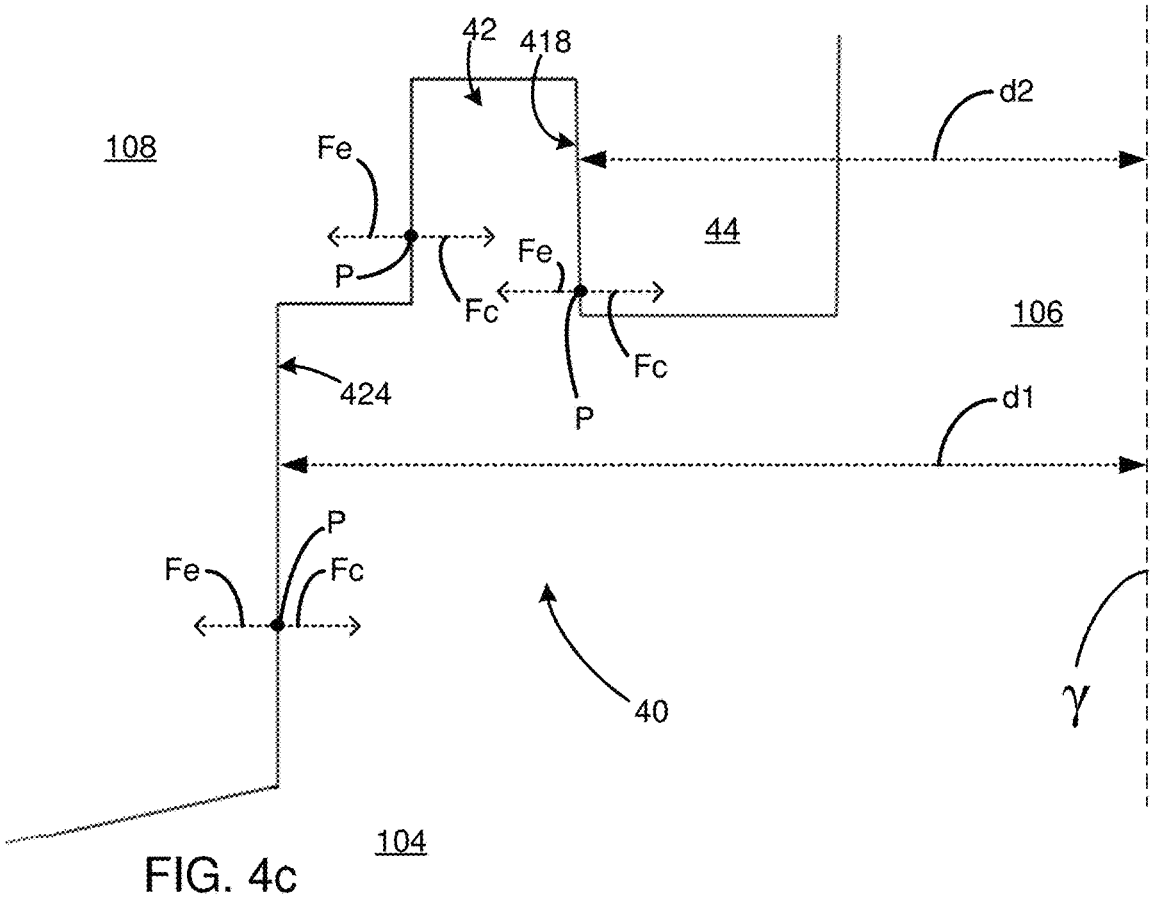
FIG. 4*c* is a schematic cross-sectional side view of an alternate valve seat well according to the present invention.
Figure 4D:
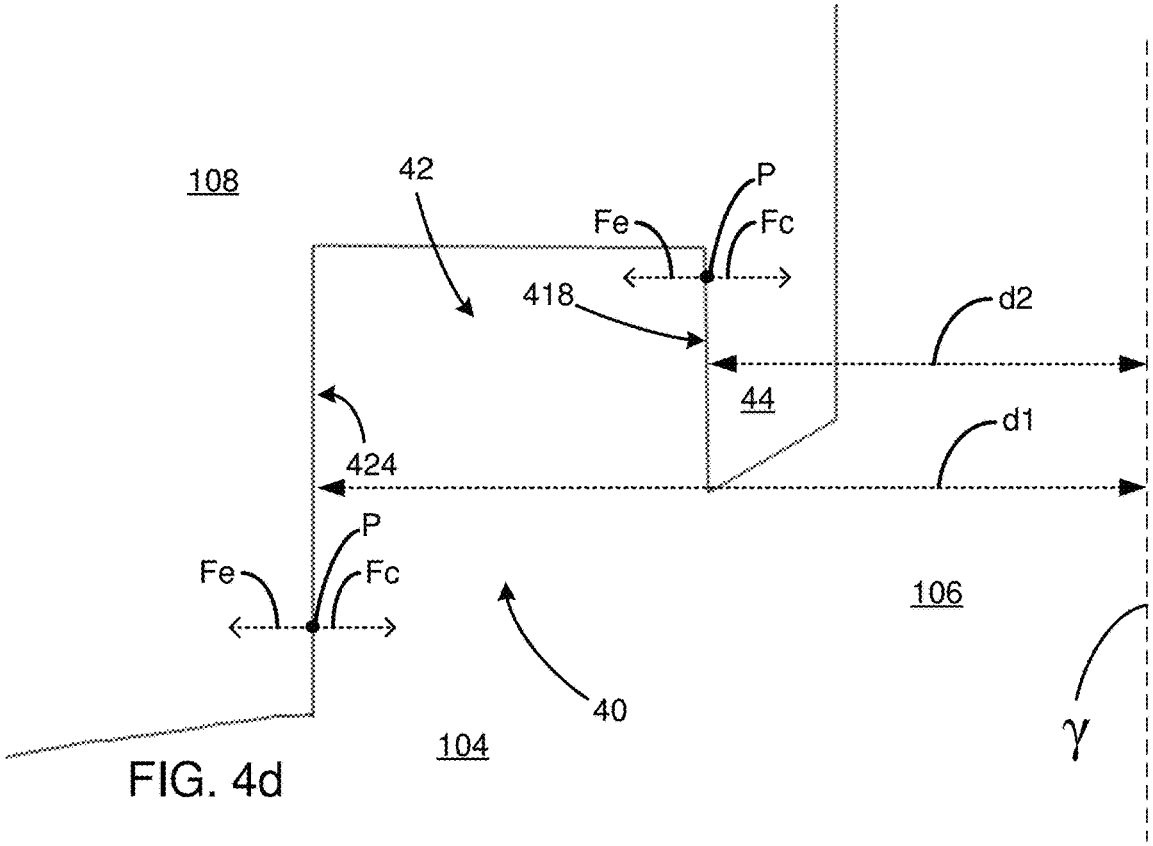
FIG. 4*d* is a schematic cross-sectional side view of an alternate valve seat well according to the present invention.

An exemplary embodiment of the current appendaged seat 100 is shown in FIGS. 1-3. The valve seat 100 has a ringed shape with a seat perimeter 101. Many aspects of valve seat 100 are similar to prior art valve seats, with a seat face 102 oriented toward a combustion chamber 104. The center of the valve seat 100 is a circular void that forms part of the valve channel 106 through which fuel-air mixture may enter and exhaust may exit the combustion chamber 104. The seat face 102 is the element against which a valve (not shown) is intended to rest to prevent fluid flow through the valve channel 106. The seat face 102 typically fans-out at an angle $\alpha$, which corresponds to a flared angle of the corresponding sealing surface of the appropriate valve (not shown). The flare may be a flat angled section or a precise arc that contacts the valve face and provides good sealing and heat transfer when the valve is closed, and good gas-flow characteristics through the valve port when it is open. The ringed shape of the valve seat 100 creates a reference axis $\beta$ around which the cylindrical features of valve seat 100 may be seen as encircling.

An additional feature shown in FIG. 3 is a seat appendage 110. The seat appendage 110, which may extend from the body of the valve seat 100 distal the seat face 102.

Referring now primarily to FIGS. 4*a*, 4*b*, 4*c*, and 4*d*, a variety of modified valve seat wells 40 useable in a variety of engines are shown. It is appreciated that other configurations of seat wells 40 may be applicable to the present teachings. In the exemplary embodiments, the seat wells 40 are located in the engine head 108, which is a typical configuration, but there are situations where the seat wells 40 may be in a different part of the engine, such as the engine block. It is appreciated that the exemplary seat wells 40 may be round, and centered on a well axis $\gamma$. The seat wells 40 are located at the interface between the engine head 108 and the combustion chamber 104, where the valve channel 106 accesses the combustion chamber 104.

To accommodate the seat 100 with a seat appendage 110, an exemplary seat well 40 may have a counter-bored groove 42 that may extend a portion of the seat well 40 further into the engine head 108 in a direction radially parallel to well axis $\gamma$. In the exemplary embodiment, the counter-bored groove 42 creates an engine finger 44 of engine material of head 108 remaining between the counter-bored groove 42 and the valve channel 106. In the exemplary embodiment, the finger 44 of engine material completely circles the valve channel 106, centered on well axis $\gamma$.

In the exemplary embodiment, seat well 40 has a seat bore outer face 424, and an engine finger face 418. In the exemplary embodiment the engine finger face 418 is radially parallel to the seat bore outer face 424. The seat bore outer face 424 is a distance d1 away from the well axis $\gamma$, and the engine finger face 418 is a distance d2 away from the well axis $\gamma$. In the exemplary embodiment, distance d1 is greater than distance d2.

During expansion or contraction of the engine 108 and an accompanying seat 100, point P, on either or both engine finger face 418 or seat bore outer face 424, will experience forces of expansion Fe or forces of contraction Fc. The contact pressure at point P on the engine finger face 418 will decrease if the force of expansion Fe of the seat 100 is greater than the corresponding force of expansion Fe of the engine 108. Conversely, the contact pressure at point P on the seat bore outer face 424 will increase if the force of expansion Fe of the seat 100 is greater than the corresponding force of expansion Fe of the engine 108. Additionally, the contact pressure at point P on the engine finger face 418 will increase if the force of contraction Fc of the seat 100 is greater than the corresponding force of contraction Fc of the engine 108. It follows that the contact pressure at point P on the seat bore outer face 424 will decrease if the force of contraction Fc of the seat 100 is greater than the corresponding force of contraction Fc of the engine 108.

It then follows that an increase in the contact pressure at point P, on either or both engine finger face 418 or seat bore outer face 424, will increase the retaining forces between a seat 100 positioned in the seat well 40 and counter bore groove 42, and the engine 108 and an engine finger 44. It also follows that a decrease in the contact pressure at point P, on either or both engine finger face 418 or seat bore outer face 424, will decrease the retaining forces between a seat 100 positioned in the seat well 40 and counter bore groove 42, and the engine 108 and an engine finger 44. Important to the current invention is that a decrease in the retaining forces at point P on the engine finger face 418 can be simultaneously offset by an increase in the retaining forces at point P on the seat bore outer face 424. Alternatively, a decrease in the retaining forces at point P on the seat bore outer face 424 can be simultaneously offset by an increase in the retaining forces at point P on the engine finger face 418.

A decrease in retaining force on a point P on the engine finger face 418 will be offset, at least in part, by an increase in the retaining force on a point P on seat bore outer face 424. Alternatively, a decrease in retaining force on a point on the seat bore outer face 424 will be offset, at least in part, by an increase in the retaining force on a point on engine finger face 418. Said another way, a decrease in retaining force on a point P on either the engine finger face 418 or the seat bore outer face 424 will be offset by an increase in the retaining force on a point P the other of either engine finger face 418 or the seat bore outer face 424.

Figure 5A:
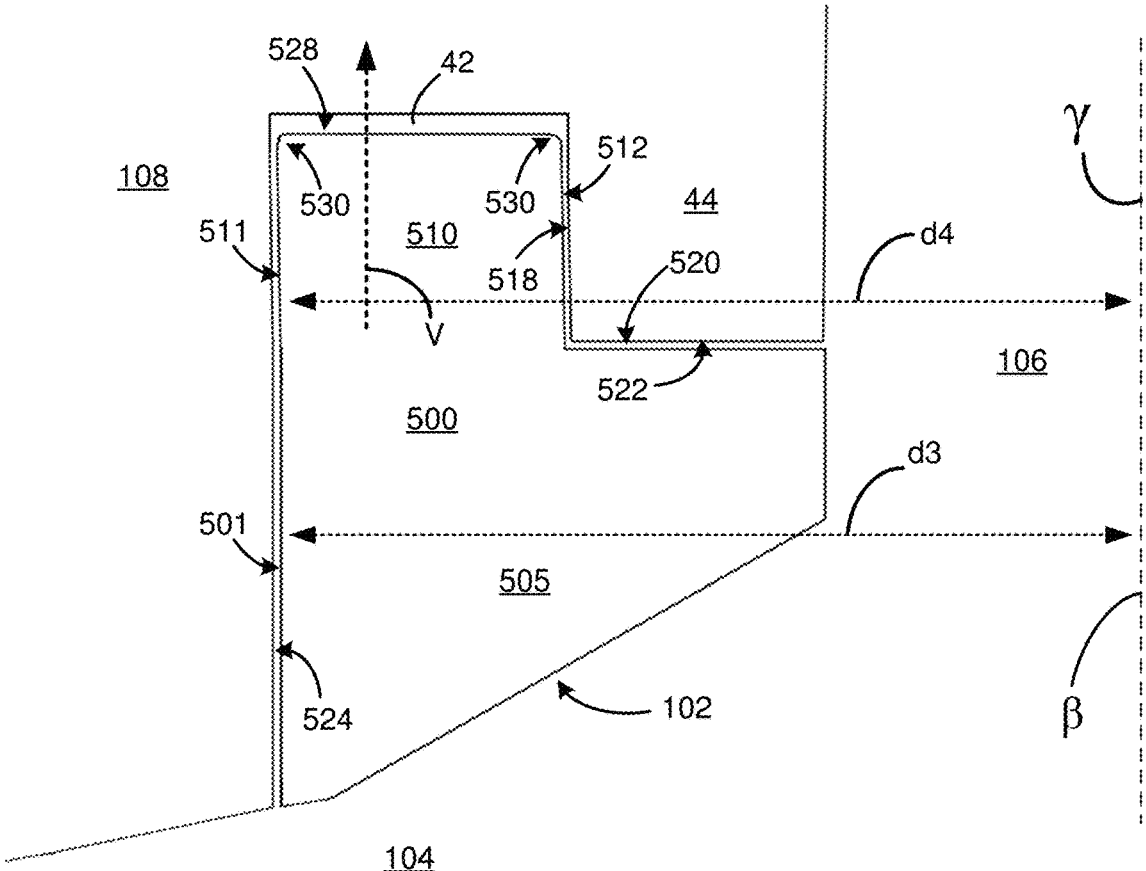
FIG. 5*a* is a schematic side view illustration of a cutaway embodiment of the current appendaged valve seat similar to that shown in FIG. 3 seated in the modified valve seat well shown in FIG. 4*a;*
Figure 5B:
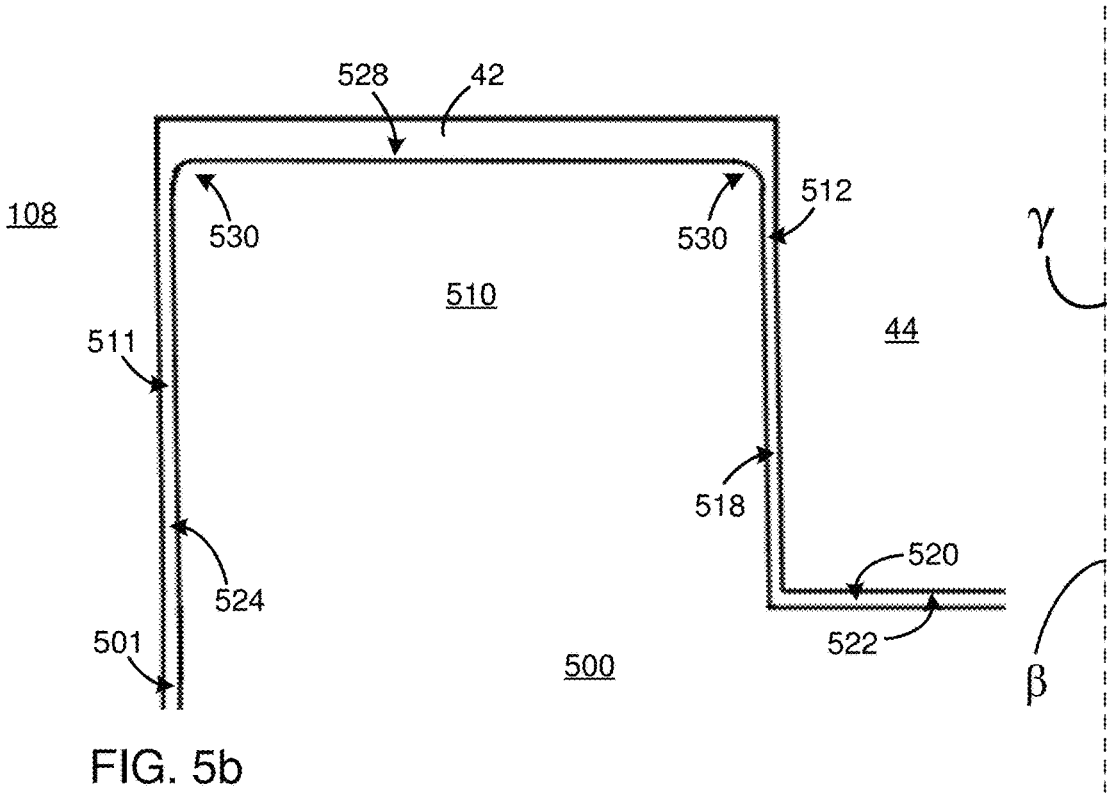
FIG. 5*b* is an enlarged view of the valve seat appendage illustrated in FIG. 5*a;*

Referring now primarily to FIGS. 5*a* and 5*b*, an exemplary appendage valve seat 500, similar in structure to the appendage valve seat 100 in FIG. 3, is schematically shown from a cut-through side to show orientation and features with respect to the engine head 108. The interface gaps shown are not to scale, but are enlarged for illustration purposes. As in appendaged valve seat 100, appendaged valve seat 500 may have a seat perimeter 501 may be seen to form the exterior circumferential, cylindrical surface of valve seat 500 centered on axis β. The distance between the seat perimeter 501 and the seat axis β is illustrated by line d3. Appendaged valve seat 500 may have a valve seat body 505 and an appendage 510. Vector V illustrates that seat appendage 510 may extend outwardly, in the direction of vector V from the seat body 505, radially parallel to the seat axis β.

In the exemplary embodiment, appendage 510 may have an appendage perimeter 511 that aligns with the seat perimeter 501, radially parallel to axis β and distal axis β. In its entirety, exemplary appendage perimeter 511 may be seen to form a circumferential, cylindrical exterior surface of exemplary appendage 510 centered on axis β. The distance between the appendage perimeter 511 and the seat axis β is illustrated by line d4. An exemplary appendage face 512 may be radially parallel to appendage perimeter 511, and on the opposite side of appendage 510. In its entirety, exemplary appendage face 512 may be seen to form a circumferential, cylindrical interior surface of exemplary appendage 510 radially parallel to appendage perimeter 511, and similarly centered on seat axis β.

In an installed configuration, seat axis β and well axis γ may be co-located, and appendage 510 of seat 500 may extend into a counter-bored groove 42 in engine head 108. An exemplary engine finger 44 may be seen as formed between the valve channel 106 and the counter-bored groove 42. An engine finger face 518 may be formed to be radially parallel to appendage face 512, appendage perimeter 511 and seat perimeter 501 when valve seat 500 is properly seated in engine head 108 in the installed configuration. Exemplary valve seat 500 may have a reference stop 520 perpendicular to seat perimeter 501 and a point on axis β. Reference stop 520 may abut engine finger face 522 when valve seat 500 is properly seated in engine head 108 in the installed configuration. A tight abutment between reference stop 520 and engine finger face 522 may prohibit combustion residue from valve channel 106 entering into the interface and creating unwanted debris accumulation.

In an installed configuration, engine finger face 522 abuts against reference stop 520, engine finger face 518 abuts against appendage face 512, seat perimeter 501 abuts against seat bore outer face 524, and engine finger face 518, appendage face 512, seat perimeter 501, seat bore outer face 524, and appendage perimeter 511 are cylindrically parallel around co-located axis β and axis γ.

In an installed configuration, the point P on engine finger face 418 is closer to seat axis β and well axis γ than the point P on seat bore outer face 424. Therefore, the point P on engine finger face 418 may be referred to as the "inner impingement point" and the point P on seat bore outer face 424 may be referred to as the "outer impingement point." Using this referencing convention, a decrease in retaining force on either the inner impingement point P or the outer impingement point P is offset by an increase in the other of the inner impingement point P and the outer impingement point P.

When valve seat 500 is properly seated in engine head 108 in the installed configuration seat perimeter 501 may abut firmly against seat bore outer face 524. To obtain secure press-fit interference between the valve seat 500 and the engine head 108 seat perimeter 501 and appendage face 512 may be precisely, correspondingly sized to abut firmly against seat bore outer face 524 and engine finger face 518. In this disclosure, press-fit interference is the amount that the distance between exemplary seat perimeter 501 and appendage perimeter 511, and exemplary appendage face 512 is greater than the width of the exemplary counter-bored groove 42. A press-fit interference of between 0.0001 and 0.002 is suggested, but the precise interference fit may vary dependent upon materials and component sizes, as do conventional interference specs. However, the current invention permits reliable seating with less interference fit, so it may be press-fit to an installed configuration under ambient temperatures.

Exemplary appendage 510 may have an exemplary appendage leading face 528, which faces the bottom of exemplary counter-bored groove 42. Exemplary edges 530 may be seen as formed at both the interface of exemplary appendage perimeter 511 and exemplary appendage leading face 528, and exemplary appendage face 512 and exemplary appendage leading face 528. Edges 530 may be the edge of exemplary appendage 510 distal seat face 102.

Exemplary edges 530 may be slightly rounded sufficiently to permit the smooth insertion of appendage 510 into the counter-bored groove 42. Edges 530 may be rounded in order to enable the press-fitting of exemplary appendage 510 into counter-bored groove 42 when appendage 510 is sized slightly larger than counter-bored groove 42, as may be desirable to obtain a secure press-fit interference between the exemplary valve seat 500 and the engine head 108 in an installed configuration. A rounded edge may permit the narrower appendage leading edge 528 at the start of the curve radii of the rounded edges 530 to fit in between the seat bore outer face 524 and the engine finger face 518. The rounded edges 530 may then push the edge material of the seat bore outer face 524 and the engine finger face 518 outwardly during press-fitting. A sharp leading edge to the appendage 510 might likely shave material off the opening edge of the seat bore outer face 524 and the engine finger face 518, potentially creating unwanted debris in the counter-bored groove 42.

In the exemplary embodiment, the counter-bored groove 42 may be cut with the groove for the appendage 510 being slightly deeper than required to abut reference shoulder 520 and engine finger face 522 in an installed configuration, creating a space between the bottom wall of the counter-bored groove 42 and the appendage leading edge 528. Unwanted debris may be pushed into this space so it may not interfere with the proper function of the engine and its components.

In an exemplary embodiment, the present design may result in increased retention impingement between the valve seat appendage 510 and the finger of engine material 44, which may offset the other diminished impingement areas between the seat perimeter 501 of the appendaged valve seat 500 and the seat bore outer face 524 of the engine 108. This effect may be experienced in an over-heating situation or in a situation where the engine system is in extreme cold when it is started. With an increase or decrease in temperature, both the engine 108 and the seat 500 expand or contract according to the material's coefficient of thermal expansion.

It is understood that when an engine is heated the bores within the engine expand radially. In FIGS. 4*a*-4*d*, such expansion would mean that d1 and d2 would both increase. Insert components, such as valve seats typically also expand, however, they expand to a different amount or degree. The amount or degree of expansion may depend on several factors and physical properties of the material. In a general heating example, the engine may be primarily made of aluminum, which expands substantially, and the valve seats may be made of a steel alloy, which may expand to a substantially lesser degree. A conventional press-fit installation, assisted with heat-treatment of the engine and cold-treatment of the valve seat, may still reach a point during extreme operation where the expanded conventional engine seat well will be large enough to no longer hold the slightly expanded seat.

The present development overcomes the differences, regardless of the coefficient of thermal expansion differences, by having multiple radially parallel interface surfaces where the position of the material, with regard to the central axis β and well axis γ, around which the predominant expansion occurs, is alternated.

Still referring to FIGS. 5*a* and 5*b*, when the engine 108 and the seat 500 are made of materials with different coefficients of thermal expansion, the degree either part changes in size varies. When heated there is an increased distance between axis β and any point in engine 108 and engine finger 44, and at the same time a different increase in distance between axis β and any point in seat 500, including appendage 510. The present disclosed design has at least two sets of radially parallel interface surfaces between the engine material (108, 44), and the seat 500 and appendage 510. One set of these interface surfaces is the engine 108 and the appendage perimeter 511, and the other set is the appendage face 512 and the engine finger 44. Since in the first instance the seat 500 is closer to the axis β than the engine 108, and the second instance the engine 108 is closer to the axis β than the seat 500, when the force between the surfaces in one interface decreases, the force between the surfaces in the other radially parallel interface increases. Though there may be slight differences in the amount of the increase and decrease between the two interfaces, the effect is sufficient to provide a substantial improvement in reliability that the appendage seat 500 will stay in place in engine 108.

Referring now also to FIGS. 4*a*-4*d*, since the expansion or contraction happens radially from joined central axis β and well axis γ, the forces of expansion Fe and forces of contraction Fc are perpendicular to central axis β and well axis γ. Temporarily referring to FIGS. 4*a*-4*d*, 5*a* and 5*b*, 6, 7, and 8, geometry demands those forces of expansion Fe and forces of contraction Fc are therefore perpendicular to either or both engine finger face (418, 518, 618, 718, 818) or seat bore outer face (424, 524, 624, 724, 824) at a respective point P. It is similarly true then that the forces of expansion Fe and forces of contraction Fc are therefore perpendicular to any surface radially parallel to either or both engine finger face (418, 518, 618, 718, 818) or seat bore outer face (424, 524, 624, 724, 824) at a respective point P.

Figure 6:
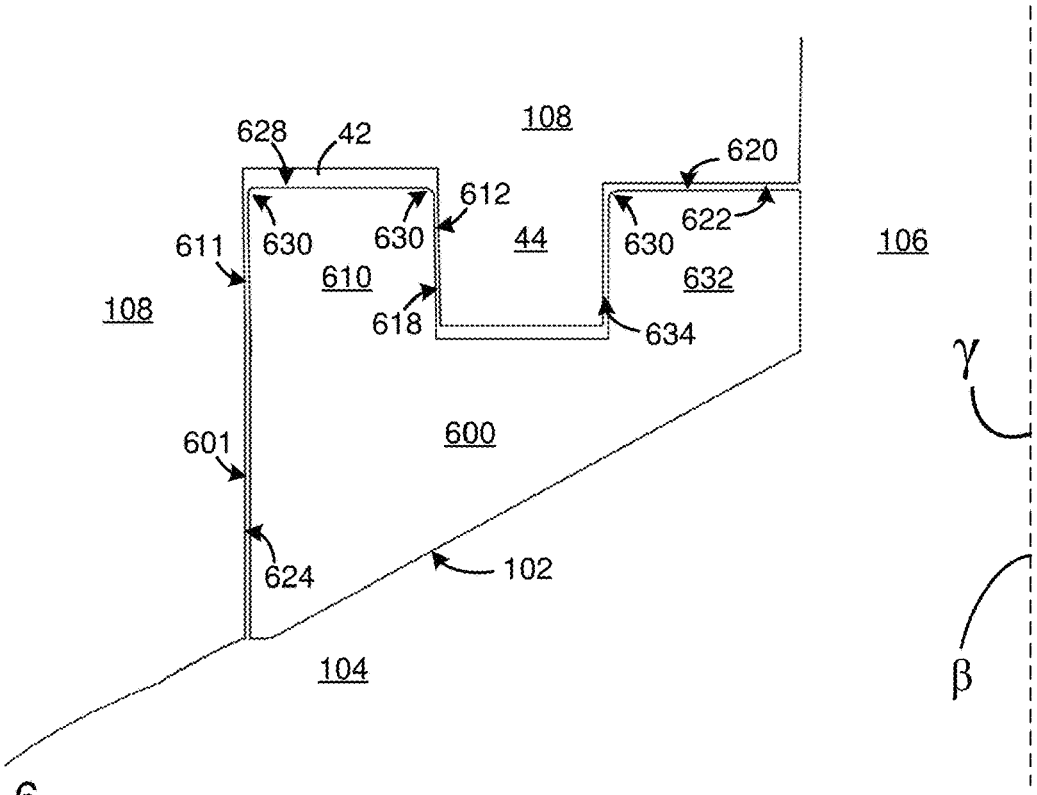
FIG. 6 is a schematic side view of a cutaway alternate embodiment valve seat seated in the modified valve seat well shown in FIG. 4*b;*

Referring now primarily to FIG. 6, an alternate exemplary appendage valve seat 600 is schematically shown from a cut-through side, as done in FIG. 4, to show orientation and features with respect to an engine head 108 in a simplified manner. The interface gaps shown are not to scale, but are enlarged for illustration purposes. Axis β is depicted to provide a reference to its general location from the valve seat 600, but the distance axis β is from the valve seat 600 is not to scale.

As in appendaged valve seat 100, appendaged valve seat 600 has an exemplary seat perimeter 601 that forms the exterior circumferential, cylindrical surface of the valve seat 600 centered on axis β. In the exemplary embodiment, appendage 610 has an appendage perimeter 611 that is aligned with the seat perimeter 601 radially parallel to axis β and distal axis β. In its entirety, exemplary appendage perimeter 611 forms a circumferential, cylindrical exterior surface of exemplary appendage 610 centered on axis β. An appendage face 612 is radially parallel to the appendage perimeter 611 and on the opposite side of the appendage 610 from the appendage perimeter 611. In its entirety, exemplary appendage face 612 forms a circumferential, cylindrical, inwardly oriented surface of appendage 610 centered on axis β.

Exemplary appendage 610 extends into a counter-bored groove 42 in engine head 108. An exemplary engine finger 44 is formed between the valve channel 106 and the counter-bored groove 42. An engine finger face 618 is formed that is radially parallel to appendage face 612, appendage perimeter 611 and seat perimeter 601 when exemplary alternate valve seat 600 is properly seated in engine head 108. Exemplary valve seat 600 has a reference stop 620, which may be perpendicular to seat perimeter 601 and a point on axis β. Reference stop 620 is intended to abut engine finger stop 622 when valve seat 600 is properly seated in engine head 108.

When valve seat 600 is properly seated in engine head 108 seat perimeter 601 abuts firmly against seat bore outer face 624. To obtain secure press-fit interference between the alternate valve seat 600 and the engine head 108 seat perimeter 601 must be precisely, correspondingly sized to abut firmly against seat bore outer face 624. In this disclosure press-fit interference is the amount that the distance between seat perimeter 601 and appendage face 612 is greater than the width of the counter-bored groove 42. As with exemplary embodiment valve seat 500, press-fit interference of between 0.0005 and 0.002 is suggested for exemplary valve seat 600.

Exemplary appendage 610 has an appendage leading face 628, which faces the bottom of counter-bored groove 42. Edges 630 are formed at both the interface of appendage perimeter 611 and appendage leading face 628, and appendage face 612 and appendage leading face 628. Exemplary edges 630 are at the edge of appendage 610 distal seat face 102. Exemplary edges 630 may be slightly rounded sufficiently to permit the smooth insertion of appendage 610 into the counter-bored groove 42. Edges 630 may be rounded in order to enable the press-fitting of appendage 610 into counter-bored groove 42 when appendage 610 is sized slightly larger than counter-bored groove 42, as is desirable to obtain a secure press-fit interference between the valve seat 600 and the engine head 108.

Exemplary alternate valve seat 600 may have one or more additional appendages 632. Additional appendages 632 may have similar features as appendage 610 to facilitate proper press-fit installation. Additional appendages 632 may have a finger interface 634 radially parallel to the interface formed by appendage face 612 and engine finger face 618.

Figure 7:
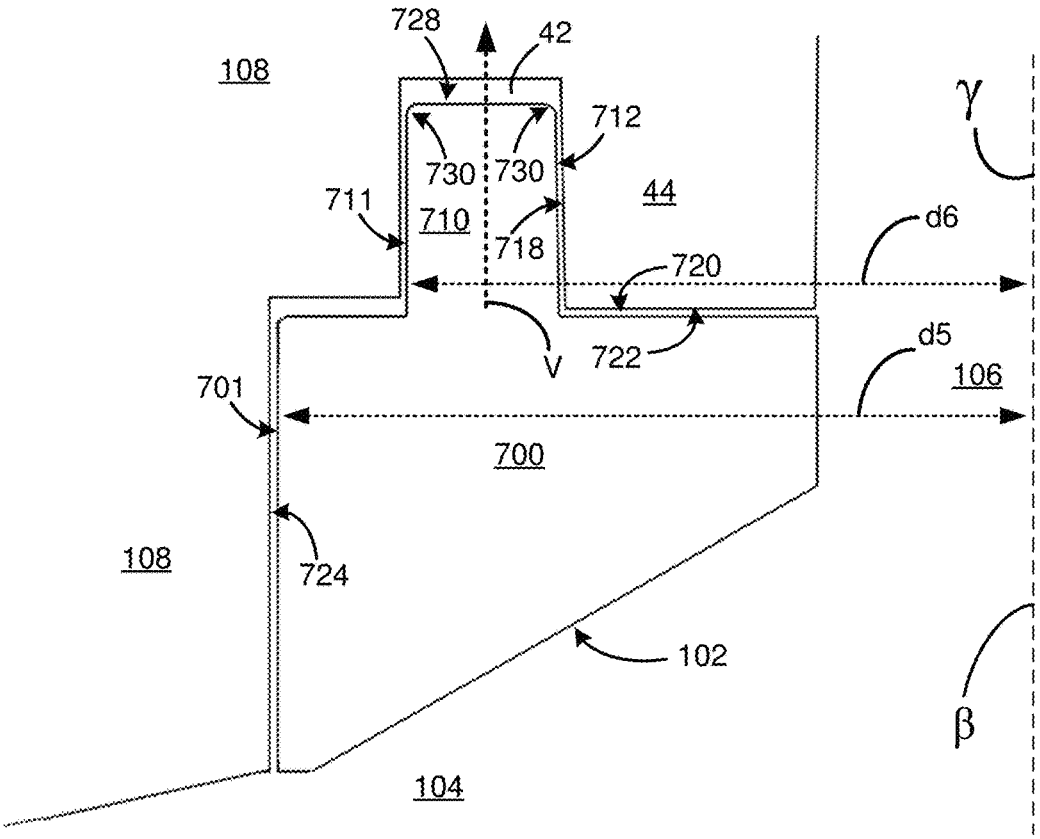
FIG. 7 is a schematic side view of an additional cutaway alternate embodiment valve seat seated in the modified valve seat well shown in FIG. 4*c;*

Referring now primarily to FIG. 7, an additional alternate exemplary appendage valve seat 700 is schematically shown from a cut-through side, as done in FIG. 4, to show orientation and features with respect to an engine head 108 in a simplified manner. The interface gaps shown are not to scale, but are enlarged for illustration purposes. Axis β is depicted to provide a reference to its general location from the valve seat 700, but the distance axis β is from the valve seat 700 is not to scale. The distance between the seat perimeter 701 and the seat axis β is illustrated by line d5.

As in appendaged valve seat 100, appendaged valve seat 700 has an exemplary seat perimeter 701 that forms the exterior circumferential, cylindrical surface of the valve seat 700 centered on axis β. In the exemplary embodiment, appendage 710 has an appendage perimeter 711 that is radially parallel to the seat perimeter 701. The distance between the appendage perimeter 711 and the seat axis β is illustrated by line d6. An appendage face 712 is radially parallel to the appendage perimeter 711 and on the opposite side of the appendage 710 from appendage perimeter 711, closer to axis β. In its entirety, exemplary appendage face 712 forms a circumferential, cylindrical interior surface of exemplary appendage 710 centered on axis β.

Exemplary appendage 710 extends into a counter-bored groove 42 in engine head 108. An exemplary engine finger 44 is formed between the valve channel 106 and the counter-bored groove 42. An engine finger face 718 is formed that is radially parallel to appendage face 712, appendage perimeter 711 and seat perimeter 701 when exemplary alternate valve seat 700 is properly seated in engine head 108. Exemplary valve seat 700 has at least one reference stop 720, which may be perpendicular to seat perimeter 701 and a point on axis β. Reference stop 720 is intended to abut at least one engine finger stop 722 when valve seat 700 is properly seated in engine head 108.

When valve seat 700 is properly seated in engine head 108 seat perimeter 701 abuts firmly against exemplary seat bore outer face 724. To obtain secure press-fit interference between the alternate valve seat 700 and the engine head 108 seat perimeter 701 must be precisely, correspondingly sized to abut firmly against seat bore outer face 724. In this disclosure press-fit interference is the amount that the distance between seat perimeter 701 and appendage face 712 is greater than the width of the counter-bored groove 42. As with exemplary embodiment valve seat 600, press-fit interference of between 0.0005 and 0.002 is suggested for exemplary valve seat 700.

Exemplary appendage 710 has an appendage leading face 728, which faces the bottom of counter-bored groove 42. Edges 730 are formed at both the interface of appendage perimeter 711 and appendage leading face 728, and appendage face 712 and appendage leading face 728. Exemplary edges 730 are at the edge of appendage 710 distal seat face 102. Exemplary edges 730 may be slightly rounded sufficiently to permit the smooth insertion of appendage 710 into the counter-bored groove 42. Edges 730 may be rounded in order to enable the press-fitting at ambient temperatures of appendage 710 into counter-bored groove 42 when appendage 710 is sized slightly larger than counter-bored groove 42, as is desirable to obtain a secure press-fit interference between the valve seat 700 and the engine head 108.

Exemplary alternate valve seat 700 may have one or more additional appendages 732 coaxial to axis β. Additional appendages 732 may have similar features as appendage 710 to facilitate proper press-fit installation. Additional appendages 732 may have a finger interface 734 radially parallel to the interface formed by appendage face 712 and engine finger face 718, and centered on axis β.

Figure 8:
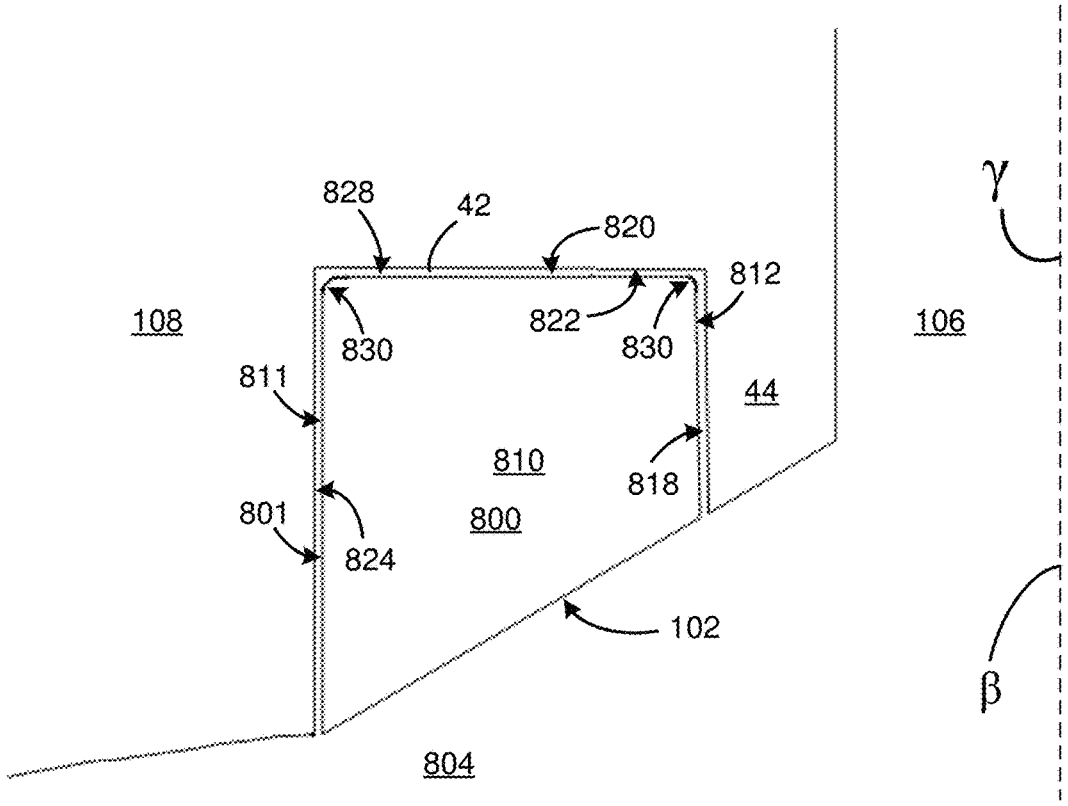
FIG. 8 is a schematic side view of a further additional cutaway alternate embodiment valve seat seated in the modified valve seat well shown in FIG. 4*d;*

Referring now primarily to FIG. 8, a further additional alternate exemplary appendage valve seat 800 is schematically shown from a cut-through side, as done in FIG. 4, to show orientation and features with respect to an engine head 108 in a simplified manner. The interface gaps shown are not to scale, but are enlarged for illustration purposes. Axis β is depicted to provide a reference to its general location from the valve seat 800, but the distance axis β is from the valve seat 800 is not to scale.

As in appendaged valve seat 100, appendaged valve seat 800 has an exemplary seat perimeter 801 distal axis β that forms the exterior circumferential, cylindrical surface of the valve seat 800 centered on axis β. In the exemplary embodiment of appendaged valve seat 800, appendage 810 is embodied in the upper portion of appendaged valve seat 800 distal seat face 102. In the exemplary embodiment, appendage 810 has an appendage perimeter 811 that is radially parallel to the seat perimeter 801. An appendage face 812 is radially parallel to the appendage perimeter 811 and on the opposite side of the appendage 810 from appendage perimeter 811. In its entirety, exemplary appendage face 812 forms a circumferential, cylindrical interior surface of exemplary appendage 810 centered on axis β.

Exemplary appendage 810 extends into a counter-bored groove 42 in engine head 108. An exemplary engine finger 44 is formed between the valve channel 106 and the counter-bored groove 42. An engine finger face 818 is formed that is radially parallel to appendage face 812, appendage perimeter 811, seat perimeter 801 and axis β, when exemplary alternate valve seat 800 is properly seated in engine head 108. Exemplary valve seat 800 has a reference stop 820, which may be perpendicular to seat perimeter 801 and a point on axis β. Reference stop 820 is intended to abut the engine finger stop 822 formed by the bottom of the counter-bored groove 42 when valve seat 800 is properly seated in engine head 108.

When valve seat 800 is properly seated in engine head 108 seat perimeter 801 abuts firmly against exemplary seat bore outer face 824. To obtain secure press-fit interference between the alternate valve seat 800 and the engine head 108 seat perimeter 801 must be precisely, correspondingly sized to abut firmly against seat bore outer face 824. In this disclosure press-fit interference is the amount that the distance between seat perimeter 801 and appendage face 812 is greater than the width of the counter-bored groove 42. As with prior exemplary embodiment valve seat 600, press-fit interference of between 0.0005 and 0.002 is suggested for exemplary valve seat 800.

Exemplary appendage 810 has an appendage leading face 828, which faces the bottom of counter-bored groove 42. Edges 830 are formed at both the interface of appendage perimeter 811 and appendage leading face 828, and appendage face 812 and appendage leading face 828. Exemplary edges 830 are at the edge of appendage 810, distal seat face 102.

Exemplary edges 830 may be slightly rounded sufficiently to permit the smooth insertion of appendage 810 into the counter-bored groove 42, even at ambient temperatures. Edges 830 may be rounded in order to enable the press-fitting of appendage 810 into counter-bored groove 42 when appendage 810 is sized slightly larger than counter-bored groove 42, as is desirable to obtain a secure press-fit interference between the valve seat 800 and the engine head 108. This is especially true when the various parts are not respectively heat-expanded or cold-shrunk before installation. The angling of edges 830 permits appendage leading face 828 to be positioned into the counter-bored groove 42 before the valve seat 800 makes contact with the outer edges of the counter-bored groove 42. The rounded edges 830 will then press the outer edges of the counter-bored groove 42 outwardly, rather than binding with the outer edges of the counter-bored groove 42 and potentially shaving off material, which would become unwanted debris in the counter-bored groove 42. It is appreciated that edges 830 may be angled or tapered in various manners to achieve the angled transition into the counter-bored groove 42.

Exemplary alternate valve seat 800 may have one or more additional appendages 832 coaxial to axis β. Additional appendages 832 may have similar features as appendage 810 to facilitate proper press-fit installation. Additional appendages 832 may have a finger interface 834 radially parallel to the interface formed by appendage face 812 and engine finger face 818, and centered on axis β.

Figure 9:
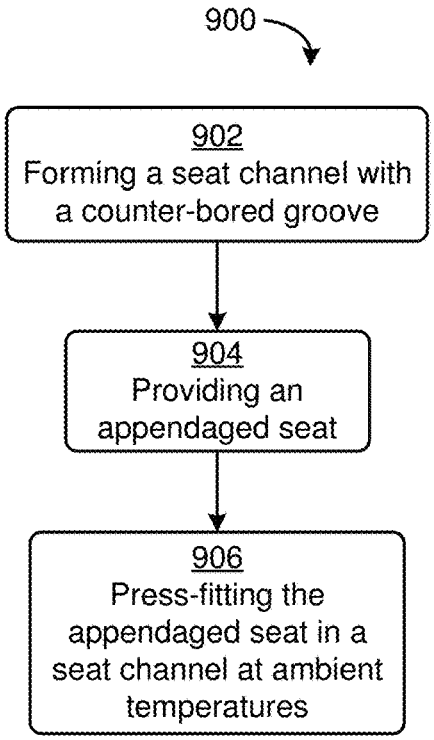
FIG. 9 is a flowchart illustrating an exemplary process for installing an appendaged valve seat in an engine.

Referring now primarily to FIG. 9, the process of securely press-fitting of the seat into the engine head at ambient temperatures 900 is shown. Given the advantageous function of the appendaged valve seat 100 (and including 500, 600, 700, and 800), the typical manufacturing steps of heating an engine head 108, called heat-treatment, and cooling a conventional seat, called cold-treatment, may be avoided. The appendaged valve seat 100 may be secured in engine head 108 by forming 902 a seat well 40 with a counter-bored groove 42 extending into the engine head 108 distal the seat face 102, and an engine finger 44 intermediate the counter-bored groove 42 and the valve channel 106.

The exemplary process may also include providing 904 an appendaged seat 500 where the seat body 505 has a seat axis β, a seat face 102 shaped to seal against a valve, and a seat perimeter 501 oriented away from the seat axis β. The appendaged seat 500 may have a seat appendage 510. The seat appendage 510 may have an appendage perimeter 511 oriented away from the seat axis β and an appendage face 512 oriented toward the seat axis β. And, the seat perimeter 501, the appendage perimeter 511, and the appendage face 512 coaxial to the seat axis β. This coaxial orientation of the seat perimeter 501, the appendage perimeter 511, and the appendage face 512, may be the same both before and after installation into an engine 108

Additionally, the exemplary process may include press-fitting 906 an appendaged valve seat 100 in a seat channel 40 at ambient temperatures with an interference fit may be accomplished by seating methods known in the field to squarely seat a valve seat in an engine head 108.

Figure 10:
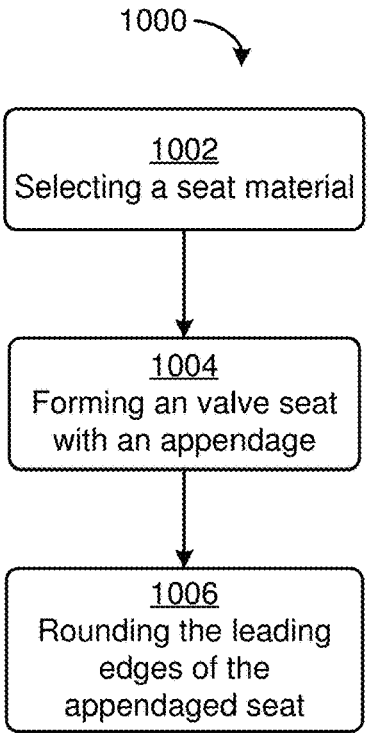
FIG. 10 is a flowchart illustrating an exemplary process for making an appendaged valve seat.

Referring now primarily to FIG. 10, the general process of making an appendaged seat 1000 is shown. The process includes selecting 1002 a desired seat material that has the desired properties for the engine. The exemplary process also includes forming 1004 a valve seat 40 with an appendage 42, using the chosen seat material, such that the seat body 505 may have a seat axis β, a seat face shaped to seal against a valve, and a seat perimeter 501 oriented away from the seat axis β, the valve seat 500 may have a seat appendage 510, the seat appendage 510 may have an appendage perimeter 511 oriented away from the seat axis β and an appendage face 512 oriented toward the seat axis β, and the seat perimeter 501, the appendage perimeter 511, and the appendage face 512 may be coaxial to the seat axis β. Additionally, rounding 1006 the leading edges 530 of the appendaged seat 500, so that the leading edges do not shave off part of the entry perimeter of the seat well 40 and create unwanted debris in the seat well 40. This rounding of the leading edges makes the seat more suitable for press-fit installation in ambient temperatures.

Example inventive scope of the currently disclosed device and process may include a valve seat 500 for an engine, having an engine head material with a different coefficient of expansion than the valve seat material, comprising a seat body 505 with a cylindrical seat perimeter 501, a seat face 102, a seat axis β, and a radial reference stop 520, the valve seat 500 having a seat appendage 510, the seat appendage 510 having a cylindrical appendage perimeter 511 and a cylindrical appendage face 512, the seat perimeter 511, the appendage face 512, and the appendage perimeter 511 coaxial to the seat axis β, the cylindrical appendage face being closer to the seat axis β than the appendage perimeter 511. Additionally, the valve seat 500 may further comprise the seat 511 extending outwardly from the seat body 505 distal the seat face 102. Further, the valve seat 500 may further comprise the appendage perimeter 511 and appendage face 512 each having a leading edge 530, and at least one of one leading edge 530 being rounded or tapered.

From another viewpoint, exemplary inventive scope may include an engine insert for an engine, the engine having an insert seat well 40, and an engine material with a different coefficient of expansion than the engine insert material, comprising, an engine insert body with an insert perimeter, an insert axis, and a radial reference stop, the engine insert body having an insert appendage, the insert appendage having an appendage perimeter and an appendage face, the insert perimeter, the appendage perimeter, and the appendage face coaxial to the insert axis, and the insert appendage extending outwardly from the insert body distal the seat face. Additionally, an exemplary embodiment may include the insert appendage extending outwardly from the insert body in a direction to make it radially parallel to the insert axis, such as to form an engine finger void between the insert appendage and the insert axis in which engine finger void a finger of engine material may be positioned between the insert appendage and the insert axis. Additionally, an exemplary embodiment may include the appendage perimeter and appendage face each having a leading edge, and at least one of one leading edge being rounded. Additionally, an exemplary embodiment may include the insert perimeter and the appendage perimeter being equidistance from the insert axis. Additionally, an exemplary embodiment may include the distance from the insert perimeter to the insert axis being greater than the distance from the appendage perimeter to the insert axis.

The examples contained in this specification are merely possible implementations of the current device and process, and alternatives to the device and to the particular steps, including the scope and sequence, may still fall within the scope of the allowed claims. The foregoing disclosure and description of the invention is illustrative and explanatory thereof. The examples contained in this specification are merely possible implementations of the current device and process, and alternatives to the particular features, elements and process steps, including scope and sequence of the steps may be changed without departing from the spirit of the invention. The present invention should only be limited by the following claims and their legal equivalents, since the provided exemplary embodiments are only examples of how the invention may be employed, and are not exhaustive.

I claim:

1. A valve seat, comprised of a material, for an engine having an engine material with a different coefficient of expansion than the valve seat material, comprising:

a seat body with a seat axis, a seat face shaped to seal against a valve, and a seat perimeter oriented away from the seat axis;

a seat appendage extending from the seat body;

the seat appendage having an appendage perimeter oriented away from the seat axis and an appendage face oriented toward the seat axis;

the seat perimeter, the appendage perimeter, and the appendage face coaxially parallel to the seat axis; and the seat perimeter and the appendage perimeter being equidistance from the seat axis.

2. The valve seat of claim 1, further comprising:

the seat appendage extending from the seat body radially parallel to the seat axis.

3. A valve seat, comprised of a material, for an engine having an engine material with a different coefficient of expansion than the valve seat material and a valve seat well, with a valve seat well outer face, and a valve seat well engine finger, comprising:

a seat body with a seat axis, a seat face shaped to seal against a valve, and a seat perimeter oriented away from the seat axis;

a seat appendage extending from the seat body;

the seat appendage having an appendage perimeter oriented away from the seat axis and an appendage face oriented toward the seat axis;

the seat perimeter, the appendage perimeter, and the appendage face coaxially parallel to the seat axis; and an engine finger void between the seat appendage and the seat axis sized to receive a valve seat well engine finger.

4. The valve seat of claim 1, further comprising:

the appendage perimeter and appendage face each having a leading edge, and at least one leading edge being rounded.

5. The valve seat of claim 3, further comprising:

a distance from the seat perimeter to the seat axis being greater than a distance from the appendage perimeter to the seat axis.

6. The valve seat of claim 3, further comprising:

an installed configuration wherein:

the appendage face, the appendage perimeter, and a valve seat well outer face are all cylindrically parallel to the seat axis and a valve seat well engine finger.

7. The valve seat of claim 6, where the installed configuration further comprising:

an inner impingement point force between the appendage face and a valve seat well engine finger, and an outer impingement point force between the appendage perimeter and a valve seat well outer face.

8. A valve seat, comprised of a material, for an engine having an engine material with a different coefficient of expansion than the valve seat material, comprising:

a seat body with a seat axis, a seat face shaped to seal against a valve, and a seat perimeter oriented away from the seat axis;

a seat appendage extending from the seat body;

the seat appendage having an appendage perimeter oriented away from the seat axis and an appendage face oriented toward the seat axis;

the seat perimeter, the appendage perimeter, and the appendage face coaxially parallel to the seat axis; and an installed configuration, for an engine having a valve seat well, with a valve seat well outer face, and an engine finger wherein:

the appendage face, an engine finger, the appendage perimeter, and a valve seat well outer face are all cylindrically parallel to the seat axis;

an inner impingement point force between the appendage face and the valve seat well engine finger, and an outer impingement point force between the appendage perimeter and a valve seat well outer face; and thermal expansion reduces either the inner impingement point force or the outer impingement point force and similarly increases the other of the inner impingement point force or the outer impingement point force.

9. The valve seat of claim 8, wherein:

thermal contraction reduces either the inner impingement point force or the outer impingement point force and similarly increases the other of the inner impingement point force or the outer impingement point force.

10. The valve seat of claim 3, further comprising:

the seat appendage extending from the seat body in a direction distal the seat face;

the engine finger void extending from the seat body in a direction distal the seat face and parallel to the seat axis; and a distance from the seat perimeter to the seat axis being greater than a distance from the appendage perimeter to the seat axis.

11. The valve seat of claim 3, further comprising:

the seat appendage extending from the seat body radially parallel to the seat axis.

12. The valve seat of claim 7, further comprising:

thermal expansion reduces either the inner impingement point force or the outer impingement point force and similarly increases the other of the inner impingement point force or the outer impingement point force.

13. The valve seat of claim 7, further comprising:

thermal contraction reduces either the inner impingement point force or the outer impingement point force and similarly increases the other of the inner impingement point force or the outer impingement point force.

* * * * *